United States Patent [19]

Aho

[11] 4,221,392

[45] Sep. 9, 1980

[54] DISK FOR A SKIING POLE

[75] Inventor: Yrjö Aho, Westend, Finland

[73] Assignee: Exel Oy, Helsinki, Finland

[21] Appl. No.: 948,320

[22] Filed: Oct. 3, 1978

[30] Foreign Application Priority Data

Oct. 3, 1977 [FI] Finland ..... 772908

[51] Int. Cl.[2] ..... A63C 11/24

[52] U.S. Cl. ..... 280/824

[58] Field of Search ..... 280/11.37 E, 11.37 Z, 280/11.37 R, 11.37 J, 11.37 B; 36/122, 123, 124, 125

[56] References Cited

U.S. PATENT DOCUMENTS

| | | | |
|---|---|---|---|
| 2,834,604 | 5/1958 | Osmun | 280/11.37 Z |
| 3,963,254 | 6/1976 | Aho | 280/11.37 Z |
| 4,057,261 | 11/1977 | Koblick | 280/11.37 Z |

FOREIGN PATENT DOCUMENTS

| | | | |
|---|---|---|---|
| 75641 | 9/1949 | Norway | 280/11.37 E |
| 111440 | 8/1944 | Sweden | 280/11.37 E |

*Primary Examiner*—David M. Mitchell

[57] ABSTRACT

A disk for a skiing pole comprises a sleeve-like part, a peripheral main frame extending asymmetrically from said sleeve-like part, and a plurality of supporting lands integrally interconnecting the sleeve-like part and the main frame, whereby the lands and the main frame form a relatively rigid body located asymmetrically with respect to the sleeve-like part. The disk further comprises an auxiliary body including a plurality of attachment prongs engagable with the rigid body for removably attaching the auxiliary body to the rigid body, and an auxiliary frame portion at least partially laterally offset from the main frame when the prongs are so engaged for enlarging the bearing area of the disk.

7 Claims, 2 Drawing Figures

DISK FOR A SKIING POLE

BACKGROUND OF THE INVENTION

The present invention pertains to concerns a disk for a skiing pole, comprising a peripheral frame and a sleeve-like part, and supporting lands thereinbetween, said peripheral frame and supporting lands being asymmetrically disposed with reference to the sleeve-like part and constituting one fairly rigid body.

Asymmetrical ski pole disks of plastic of the type described have recently gained great popularity among skiers and among competing skiers in particular. Since one of the objectives considered in connection with disks for competing skiers is to minimize their weight, and since the skiing tracks on which competitions are held have a comparatively hard surface as a rule, it has, in the case of disks of the type just described, been determined that the most propitious choice is a disk having a very small bearing surface area. It has therefore been necessary to design different disks, with a larger surface area, for those who practice skiing as a form of fitness training. Competing skiers, too, are frequently compelled to use two different sets of skiing poles when they are practicing on tracks with softer snow.

SUMMARY OF THE INVENTION

The object of the present invention is to further improve the disk of a skiing pole, of the type mentioned, so that it may be used on hard skiing tracks with a small effective surface area and, on softer tracks, with a larger bearing area.

This object is achieved, in accord with the invention, in that a separate peripheral part enlarging the bearing surface of the disk has been arranged to be detachably attachable by means of clamp prongs engaging with the frame and/or the supporting lands. Their form-locking attachment is achievable by utilizing the elastic properties of the material. As a result, the separate peripheral part is attachable rapidly and with ease. The additional part is small and easy to carry along. This possibility of attaching an extra part is afforded with particular advantage specifically in connection with asymmetrical rigid plastic disks.

It is preferable for purposes of maximizing the disk strength if the separate peripheral part is located under the peripheral part proper, except for the ends of the attachment prongs. This has the effect that pressure against the base (the snow) does not tend to undo the form-fit locking between the peripheral parts.

It is furthermore advantageous in view of strength as well as of easy attachment and detachment if two attachment prongs enter over the peripheral part of the disk on both sides of the sleeve-like part and if two further attachment prongs can be pushed, by moving the peripheral part upwardly and by bending the plastic material, in over adjacent supporting lands from the opposite sides thereof. It is then merely necessary to fit the frontmost attachment prongs in their proper place and to bend the separate peripheral part upwardly while at the same time bending the attachment prongs or the peripheral part as a whole within the limits allowed by the elastic yielding of the plastic material.

A similar lever-like effect is also achieved by other designs, in which part of the attachment prongs are substantially horizontally disposed and part of them, substantially vertically disposed.

In order to obviate, in the shaping of the attachment prongs, the need to provide for special locking of the peripheral part forwardly in a horizontal direction, a preferred embodiment of the invention features, on the separate peripheral part, supporting projections which abut against the outer edge of the peripheral part proper.

In the following the invention is described in detail, with reference being made to the attached drawings.

DESCRIPTION OF THE PREFERRED EMBODIMENTS

Figure 1:
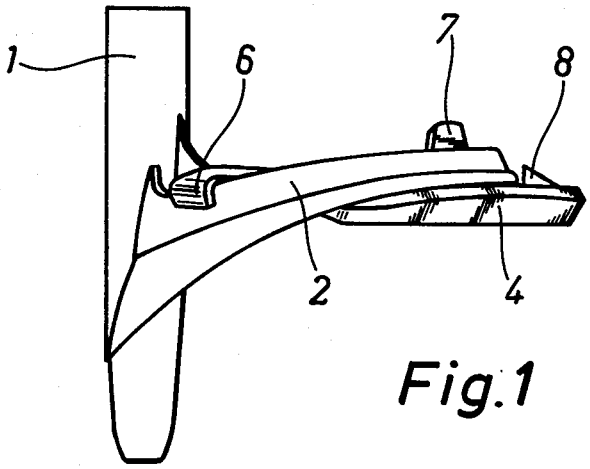
FIG. 1 shows a disk according to the invention in elevational view.
Figure 2:
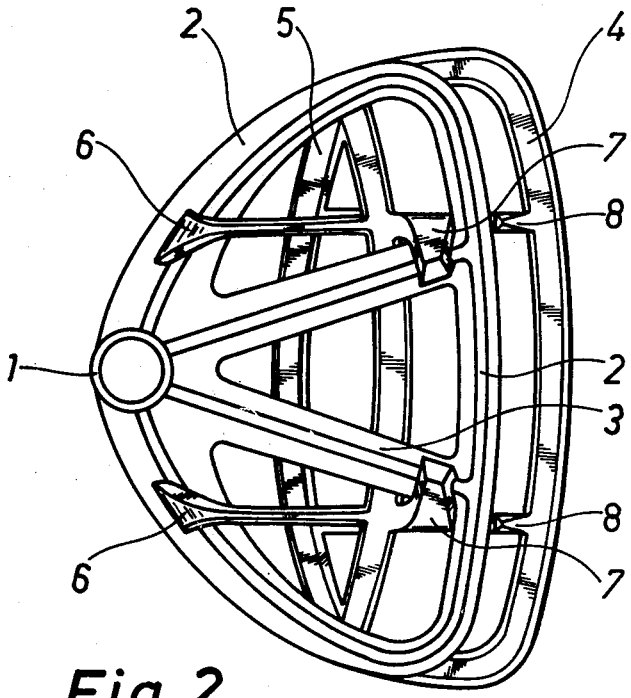
FIG. 2 shows the same, in top view.

The ski-pole disk comprises a sleeve-like part 1, to which the frame 2 has been asymmetrically affixed so that the bearing surface of the disk is established behind the sleeve-like part 1 (as viewed in the direction in which the skier progresses). Furthermore, there are supporting lands 3 between the sleeve-like part 1 and the frame 2.

To this, disk known in the prior art, there has been attached a separate peripheral part 4, with the aid of the attachment prongs 6 and 7 thereon. The separate peripheral part furthermore comprises bearing ribs 5, which increase the bearing surface of the disk also at the places where the original disk has apertures.

The horizontally running attachment prongs 6 clamp around the top edge of the peripheral part 2 on both sides of the sleeve-like part 1. The substantially vertical attachment prongs 7 enter from opposed sides of mutually adjacent supporting lands 3 in over the top edges of the supporting lands. The portion of separate peripheral part 4 exclusive of prongs 6 and 7 is located below the original peripheral frame part 2, and it is braced against the outer margin of the peripheral frame part 2 by supporting projections 8. As a consequence, the separate peripheral part is held immovably in its position and it cannot become detached of itself, because the pressure exerted against the base produces no loading force in the direction in which the attachment prongs 6 and 7 may come loose. On the contrary, this load tends to bend the peripheral part 4 in its attachment direction.

Attachment of the peripheral part 4 is accomplished by first pushing the prongs 6 from underneath into their place, thereafter bending the prongs 7 apart, either by spreading the prongs or by bending the whole peripheral part 4 to an arc, whereupon the prongs 7 can be pushed into their proper place from both sides of the supporting lands 3. Detachment is accomplished by proceeding in reverse order. It is thus understood that in the attaching and detaching procedures the elastic properties of the plastic material are made use of, and which obviates the use of mechanical, cumbersome attaching appliances altogether.

Quite naturally the invention is not confined to the embodiment example presented above: many of its details may vary within the scope of the claims following below. For instance, the clamping parts on the ends of the attachment prongs 6,7 may be replaced with fork-shaped clamping parts, and instead of plastic material one may use, for instance, a suitable, light-weight metal alloy of which it is possible to manufacture a separate peripheral part of sufficiently low weight and presenting adequate elasticity.

I claim:

1. A disk for a skiing pole comprising;

a sleeve-like part;

a peripheral main frame extending asymmetrically from said sleeve-like part;

a plurality of supporting lands integrally interconnecting said sleeve-like part and said main frame whereby said lands and said main frame form a relatively rigid body located asymmetrically with respect to said sleeve-like part;

and an auxiliary body comprising— a plurality of attachment prongs engagable with said rigid body for removably attaching said auxiliary body to said rigid body, and an auxiliary frame portion at least partially laterally offset from said main frame when said prongs are so engaged for enlarging the bearing area of said disk.

2. A disk according to claim 1 wherein said auxiliary body is comprised of an elastic material whereby said engagement of said prongs with said rigid body comprises a form-fit lock.

3. A disk according to claim 1 wherein, when said disk is oriented so that said sleeve-like part extends generally upwardly with respect to said main frame, said auxiliary frame is located under said main frame.

4. A disk according to claim 1 wherein said attachment prongs include a first pair of such prongs which, when said disk is oriented such that said sleeve-like part extends generally upwardly with respect to said main frame, extends over said main frame on opposite sides of said sleeve-like part, and a second pair of such prongs extending generally inwardly toward each other over respective ones of said lands, said auxiliary body being comprised of a material having sufficient elasticity to permit said second pair of prongs to be urged outwardly away from each other for engagement and disengagement with said rigid body.

5. A disk acccording to clam 4 wherein said first pair of prongs is disposed substantially horizontally, and said second pair of prongs is disposed substantially vertically.

6. A disk according to claim 1 wherein said auxiliary body further comprises supporting projection means carried by said auxiliary frame for abutment with the outer edge of said main frame.

7. A disk according to claim 1 wherein said main frame and said lands define a plurality of apertures therebetween, and wherein said auxiliary body further comprises rib means integrally adjoined to said auxiliary frame and positioned for at least partial alignment with said apertures to further increase the bearing area of said disk.

* * * * *